United States Patent [19]

Morris

[11] 4,152,804

[45] May 8, 1979

[54] TOOTHBRUSH

[75] Inventor: Melvyn D. Morris, London, England

[73] Assignee: Addygable Limited, London, England

[21] Appl. No.: 801,584

[22] Filed: May 31, 1977

[30] Foreign Application Priority Data

Jun. 11, 1976 [GB] United Kingdom ..... 24388/76

[51] Int. Cl.[2] ..... A46B 17/02

[52] U.S. Cl. ..... 15/167 R; 15/104.94; 15/184

[58] Field of Search ..... 15/167 R, 167 A, 184, 15/140.4, 104.94

[56] References Cited

U.S. PATENT DOCUMENTS

| | | | |
|---|---|---|---|
| 90,235 | 5/1869 | Burrows | 15/184 |
| 1,492,360 | 4/1924 | Davis | 15/104.94 |
| 1,813,361 | 7/1931 | Priest | 15/167 R X |
| 3,691,585 | 9/1972 | Flom | 15/104.94 |

*Primary Examiner*—Edward J. McCarthy

*Attorney, Agent, or Firm*—I. Morley Drucker

[57] ABSTRACT

The invention relates to a disposable toothbrush device having two elements. The first element comprises a brushing member including (i) a brushing head having flexible bristles therein, (ii) a shaft carrying the brushing head at one end thereof, (iii) an attachment means affixed to the remaining end of said shaft remote from the brushing head, and (iv) a plurality of ribs provided on the shaft adjacent the brushing head for reinforcement of shaft to render the shaft relatively rigid with respect to the bristles. The brushing head, bristles, shaft, ribs and attachment means of the brushing member are formed from a plastic material as a unitary plastic molding. The second element consists of a hollow handle in which the brushing member is housed prior to use. The handle means has one closed end, and an openable end from which the brushing member is removable from its housed position to a second brushing position wherein the attachment means on the shaft is secured onto said handle in a reverse manner from that of its housed position.

7 Claims, 2 Drawing Figures

TOOTHBRUSH

BACKGROUND OF THE INVENTION

This invention relates to a toothbrush, and particularly to a toothbrush which is intended to be thrown away after a single use.

In general terms, there is a need to provide a package containing a toothbrush, wherein the bristles of the toothbrush are impregnated with toothpaste, and a sealed, but readily removable cover is provided to protect the impregnated bristles.

The closest known prior art of which we are aware are the U.S. patents to King, U.S. Pat. No. 1,681,814 and Lodewick, U.S. Pat. No. 2,701,381. These patents, however, do not provide a toothbrush device which is economical to produce, and efficient to use.

SUMMARY OF THE INVENTION

In summary, a disposable toothbrush device is provided, by this invention, comprising the following two elements:

A. A brushing member having (i) a brushing head having flexible bristles therein, (ii) a shaft carrying the brushing head at one end thereof, (iii) an attachment means affixed to the remaining end of said shaft remote from said brushing head, and (iv) a plurality of ribs provided on said shaft adjacent the brushing head for reinforcement of said shaft to render said shaft relatively rigid with respect to the flexible bristles. The brushing head, bristles, shaft, ribs and attachment means of said member are formed from a plastic material in a unitary plastic molding; and B. The second element comprises a hollow handle means in which the brushing member is housed prior to use. The handle means is provided with one closed end, and has an openable end from which the brushing member is removable from its housed position to a second brushing position. In the brushing position, the attachment means on the shaft is secured onto the handle means in a reverse manner from that of its housed position.

The attachment means preferably comprises an externally threaded end portion on the shaft and the handle means includes an internally threaded end portion for attachment to the externally threaded end portion. An enlarged sealing and stop ring is formed intermediate the ends of the externally threaded end portion for sealing said brushing member within the handle means in said housed position and for providing also a stop means for the brushing member when it is secured to the handle means in the brushing position.

The bristles of the toothbrush device of this invention are pre-impregnated with toothpaste.

BRIEF DESCRIPTION OF THE DRAWINGS

The invention will now be described, by way of example, with reference to the accompanying drawing, in which.

DETAILED DESCRIPTION OF THE DRAWINGS

Figure 1:
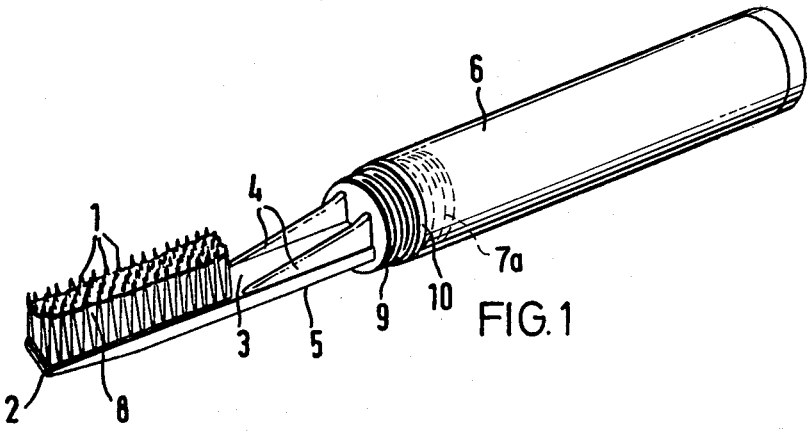
FIG. 1 is a perspective view of a package or a toothbrush according to the invention in the open or ready-for-use brushing position.
Figure 2:
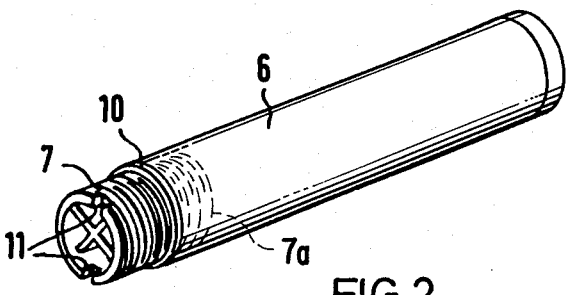
FIG. 2 is a view of the package or brush of FIG. 1, but in the closed or housed position.

The brush member has bristles 1 mounted on a head 2 formed at the end of a shaft 3. In the embodiment shown, the bristles 1, head 2 and shaft 3 are all preferably formed from a single moulding of a pliable plastics material. However, this is not essential and the brush member could be formed by any conventional method. Since the material used in this case has to be pliable so that the bristles are flexible, some stiffening is necessary on the shaft, and this is provided by two ribs 4 on the upper side, and further ribs 5 on the under side. As seen in FIG. 1 ribs 4 are tapered and have a maximum width at the head 2 tapering to a minimum width of essentially zero adjacent the head 2. A hollow handle 6, in the form of a cylinder, is secured on the end of the shaft 3 opposite to the head 2. The handle is hollow and has an internal screwthread shown in dotted lines *7a* which screws onto an external thread 7 of shaft 3 which can be seen in FIG. 2.

The bristles 1 are impregnated with toothpaste 8. This can be done in the factory by a machine which forces the paste in amongst the bristles, so that it does not project above the tips of the individual bristles. Any type of conventional toothbrush may be used.

A second screw-thread 9 is also formed at the end of the shaft 3. When the handle 6 is unscrewed from its FIG. 1 position, it can be reversed, pushed over the shaft 3 and screwed onto thread 9. An enlarged ring 10, which is part of the moulding, is provided between the ends of threads 7 and 9, and this ring forms a seal with the end of the handle 6, when the handle is fully screwed on in its FIG. 2 position, to keep the toothpaste-containing compartment sealed before use. Ring 10 also serves as a stop means for the brushing member when it is secured to the handle means 6 in the brushing position (FIG. 1).

Slots 11 (FIG. 2) are provided at the end of the thread 7. A coin or other implement could be inserted here to aid unscrewing of the handle from the shaft.

Instead of a screw-thread connection, the two parts could be push-fitted together, or other methods of connecting could be used.

Since the toothbrush as described is inexpensive to make, it can be thrown away after a single use. The brushes may be sold from vending machines singly or in packs.

I claim:

1. A disposable toothbrush device, comprising:

a brushing member including (i) a brushing head having flexible bristles therein, (ii) a shaft carrying the brushing head at one end thereof, (iii) an attachment means affixed to the remaining end of said shaft remote from said brushing head, and (iv) a plurality of ribs provided on said shaft adjacent the brushing head for reinforcement of said shaft to render said shaft relatively rigid with respect to said bristles, said ribs being tapered and having a maximum width at the end of said shaft remote from said brushing head and tapering to a minimum width of essentially zero adjacent the head, said brushing head, bristles, shaft, ribs and attachment means of said member being formed from a plastic material as a unitary plastic molding; and a hollow handle means in which said brushing member is housed prior to use, said handle means having one closed end, and an openable end from which said brushing member is removable from its housed position to a second brushing position wherein said attachment means on said shaft is secured onto said handle in a reverse manner from that of its housed position.

2. A toothbrush device as claimed in claim 1 wherein said attachment means comprises a first threaded end portion on said shaft and said handle means includes a second threaded end portion for attachment to said first threaded end portion, and an enlarged sealing and stop ring is formed intermediate the ends of said first threaded end portion for sealing said brushing member within said handle means in said housed position and for providing also a stop means for said brushing member when secured to said handle means in brushing position.

3. A toothbrush device as claimed in claim 1 wherein the bristles of said toothbrush device are impregnated with toothpaste.

4. A toothbrush device as claimed in claim 1, wherein the hollow handle means is a hollow cylinder and the openable end thereof is provided with internal threads for mounting of said attachment means of said brushing member in both its brushing position and housed position.

5. A toothbrush device as claimed in claim 1, wherein a slot for a coin is provided on the end of said brushing member which projects from said handle means in the housed position of said brushing member 6. A toothbrush device as claimed in claim 3 wherein a sealing means is provided at the juncture of said brushing member with said openable end of said handle means to thereby seal the compartment within the housing where the toothpaste-impregnated brushing member is housed.

7. A toothbrush device as claimed in claim 1 wherein said attachment means comprises a first threaded end portion on said shaft and said handle means includes a second threaded end portion for attachment to said first threaded end portion, and an enlarged sealing ring is formed intermediate the ends of said first threaded end portion for sealing said brushing member within said handle means in said housed position.

* * * * *